US010006647B2

(12) United States Patent
Jung et al.

(10) Patent No.: US 10,006,647 B2
(45) Date of Patent: Jun. 26, 2018

(54) AIR CONDITIONING SYSTEM WITH DISTRIBUTOR FOR A PLURALITY OF INDOOR UNITS

(71) Applicant: LG ELECTRONICS INC., Seoul (KR)

(72) Inventors: Jaehwa Jung, Seoul (KR); Chiwoo Song, Seoul (KR); Kakjoong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 480 days.

(21) Appl. No.: 14/582,450

(22) Filed: Dec. 24, 2014

(65) Prior Publication Data

US 2015/0176848 A1 Jun. 25, 2015

(30) Foreign Application Priority Data

Dec. 24, 2013 (KR) ..... 10-2013-0162610

(51) Int. Cl.
*F24F 3/00* (2006.01)
*F24F 3/06* (2006.01)
*F25B 13/00* (2006.01)

(52) U.S. Cl.
CPC ..... *F24F 3/065* (2013.01); *F25B 13/00* (2013.01); *F25B 2313/005* (2013.01); (Continued)

(58) Field of Classification Search
CPC ..... F24F 3/065; F25B 13/00; F25B 2313/005; F25B 2313/006; F25B 2313/0231; (Continued)

(56) References Cited

U.S. PATENT DOCUMENTS 5,142,879 A * 9/1992 Nakamura ..... F24F 3/065 62/160
2003/0230096 A1* 12/2003 Hwang, II ..... F25B 13/00 62/160
2012/0216989 A1* 8/2012 Wakamoto ..... F25B 13/00 165/96

FOREIGN PATENT DOCUMENTS

EP 0 448 345 A1 3/1991
EP 1 371 914 A1 12/2003
EP 2 495 512 A1 9/2012

OTHER PUBLICATIONS

European Search Report issued in Application No. 14196943.6 dated May 19, 2015.

* cited by examiner

*Primary Examiner* — Travis Ruby
(74) *Attorney, Agent, or Firm* — Ked & Associates, LLP

(57) ABSTRACT

An air conditioning system may include an outdoor device disposed in an outdoor space, the outdoor device including a compressor and an outdoor heat exchanger, a plurality of indoor devices disposed in an indoor space, the plurality of indoor devices including an indoor heat exchanger, and a distributor that distributes and introduces a refrigerant into the plurality of indoor devices. The outdoor device may include an outdoor branch branched into a plurality of refrigerant paths, a first outdoor tube that extends from the outdoor branch to guide the refrigerant to a first heat exchanger of the outdoor heat exchanger, a second outdoor tube that extends from the outdoor branch to guide the refrigerant to a second heat exchanger of the outdoor heat exchanger, and a bypass tube that extends from the outdoor branch to allow the refrigerant to bypass the outdoor heat exchanger, thereby guiding the refrigerant to the compressor.

14 Claims, 9 Drawing Sheets

(52) U.S. Cl.
CPC . *F25B 2313/006* (2013.01); *F25B 2313/0231* (2013.01); *F25B 2313/0233* (2013.01); *F25B 2313/0252* (2013.01); *F25B 2313/0253* (2013.01); *F25B 2313/0272* (2013.01); *F25B 2313/02741* (2013.01); *F25B 2700/21152* (2013.01)

(58) Field of Classification Search
CPC ..... F25B 2313/0233; F25B 2313/0252; F25B 2313/0253; F25B 2313/0272; F25B 2313/02741; F25B 2700/21152
See application file for complete search history.

AIR CONDITIONING SYSTEM WITH DISTRIBUTOR FOR A PLURALITY OF INDOOR UNITS

CROSS-REFERENCE TO RELATED APPLICATION(S)

The present application claims priority under 35 U.S.C. 119 and 35 U.S.C. 365 to Korean Patent Application No. 10-2013-0162610, filed in Korea on Dec. 24, 2013, which is hereby incorporated by reference in its entirety.

BACKGROUND

1. Field

An air conditioning system and a method of controlling an air conditioning system are disclosed herein.

2. Background

Air conditioners are appliances that maintain air within a predetermined space at a most proper state according to a use and purpose thereof. In general, such an air conditioner may include a compressor, a condenser, an expansion device, and evaporator. Thus, the air conditioner has a refrigerant cycle in which compression, condensation, expansion, and evaporation processes of refrigerant may be performed. Thus, the air conditioner may heat or cool a predetermined space.

The predetermined space may be variously provided according to a place at which the air conditioner is used. For example, when the air conditioner is disposed in a home or office, the predetermined space may be an indoor space of a house or building. On the other hand, when the air conditioner is disposed in a vehicle, the predetermined space may be an interior space in which a person rides.

When the air conditioner performs a cooling operation, an outdoor heat-exchanger provided in an outdoor unit or device may serve as a condenser, and an indoor heat-exchanger provided in an indoor unit or device may serve as an evaporator. On the other hand, when the air conditioner performs a heating operation, the indoor heat-exchanger may serve as the condenser, and the outdoor heat-exchanger may serve as the evaporator.

FIG. 1 is a schematic diagram of an air conditioning system according to a related art. Referring to FIG. 1, air conditioning system 1 may include an outdoor unit or device 2, in which a compressor and an outdoor heat exchanger may be provided, a plurality of distributor 3 connected to the outdoor device 1, and a plurality of indoor units or devices 4 respectively connected to the plurality of distributors 3 and in which indoor heat exchangers may be respectively provided. The air conditioning system 1 may perform in a simultaneous operation mode in which cooling and heating operations are simultaneously performed.

As illustrated in FIG. 1, the plurality of distributors 3 may include a first distributor 3*a* and a second distributor 3*b*. The plurality of indoor devices 4 may include a first indoor device 4*a* and a second indoor device 4*b*. The first distributor 3*a* may be connected to the first indoor device 4*a*, and the second distributor 3*b* may be connected to the second indoor device 4*b*.

The plurality of distributors 3 may distribute refrigerant discharged from the outdoor device 2 into the plurality of indoor devices 4. The plurality of distributor 3 may be connected to the outdoor device 2 and the plurality of indoor devices 4 through tubes.

In detail, the outdoor device 2 and the plurality of distributors 3 may be connected to each other through three tubes. The three tubes may include a low-pressure gas tube 5, a liquid tube 6, and a high-pressure gas tube 7.

The low-pressure gas tube 5 may be a tube through which the refrigerant may flow until the refrigerant is introduced into the compressor after being evaporated in an evaporator in a refrigeration cycle. The liquid tube 6 may be a tube through which the refrigerant may flow after being condensed in a condenser. The high-pressure gas tube 7 may be a tube through which the refrigerant may flow until the refrigerant is introduced into the condenser after being compressed in the compressor. The three tubes may be branched and connected to the first distributor 3*a* and the second distributor 3*b*.

One distributor of each of the plurality of distributors 3 and one indoor device of each of the plurality of indoor devices 4 may be connected to each other through two tubes. The two tubes may include a gas tube 8, through which a gaseous refrigerant may flow and a liquid tube 9, through which a liquid refrigerant may flow.

That is, in the air conditioning system according to the related art, the outdoor device 2 and the plurality of distributors 3 may be connected to each other through the three tubes, and the distributors 3 and the indoor devices 4 may be connected to the two tubes.

As described above, when the outdoor device 2 and the plurality of distributors 3 are connected to each other through the three tubes, the outdoor device 2 and the distributors 3 may be complicated in installation and assembly. In addition, as a number of welding portions to connect the tubes and the outdoor device (or the plurality of distributors) increases, installation reliability may deteriorate.

When the refrigeration cycle is performed in a state in which the indoor devices includes heating indoor devices and cooling indoor devices, that is, in a case of a main heating simultaneous operation, in which a heating operation is mainly performed using the heating indoor devices, and a cooling operation is performed using a portion of the cooling indoor devices, pressure loss in the outdoor device may occur, deteriorating simultaneous operation performance.

In detail, the refrigerant evaporated in the cooling indoor device and the refrigerant condensed in the heating indoor device may be mixed with each other to generate a two-phase refrigerant. The two-phase refrigerant may flow into the outdoor heat exchanger through the liquid tube. Pressure loss may occur in an expansion device reducing pressure, and thereby deteriorating operation performance.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. Embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
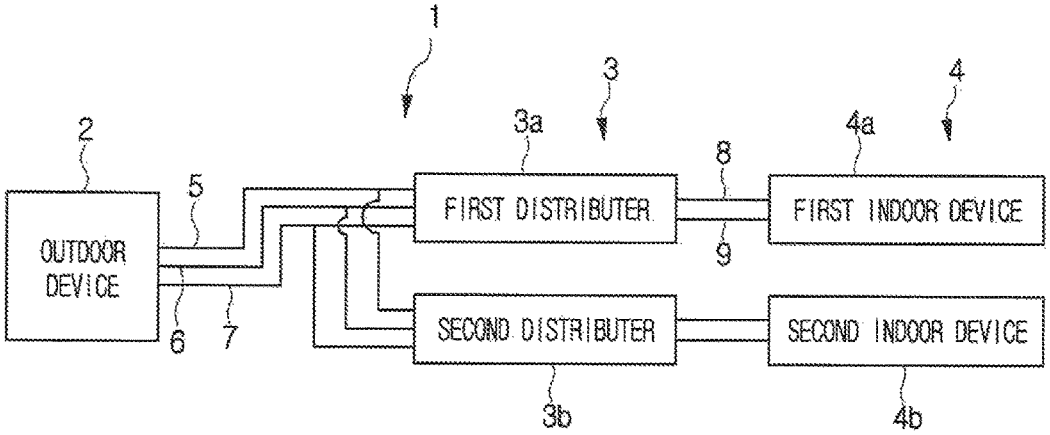
Fig. 1 RELATED ART
FIG. 1 is a schematic diagram of an air conditioning system according to a related art.
Figure 2:
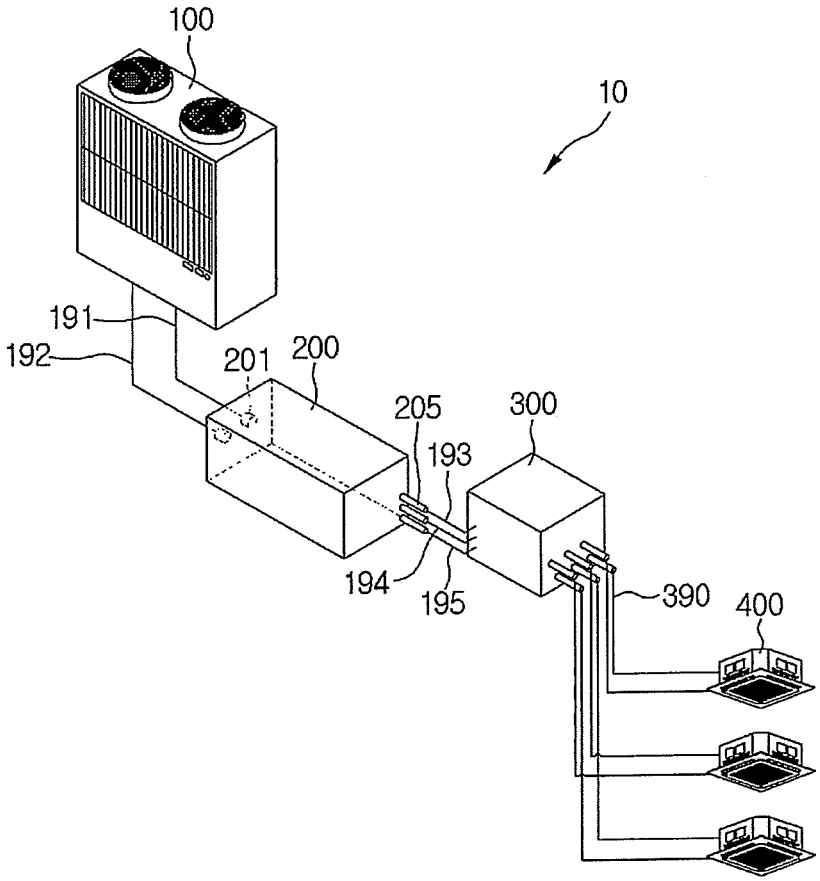
FIG. 2 is a schematic diagram of an air conditioning system according to an embodiment.

FIG. 2 is a schematic diagram of an air conditioning system according to an embodiment. Referring to FIG. 2, an air conditioning system 10 according to an embodiment may include an outdoor unit or device 100, a gas/liquid separation unit or device 200, a distribution unit or distributor 300, and a plurality of indoor units or devices 400.

In detail, the gas/liquid separation device 200 may be separably coupled to the outdoor device 100. The air conditioning system 10 may include two tubes 191 and 192 that connect the outdoor device 100 to the gas/liquid separation device 200. The two tubes 191 and 192 may include a first connection tube 191, and a second connection tube 192, which may be disposed on or at a first side of the gas/liquid separation device 200.

For example, the first connection tube 191 may include a gas tube, through which a gaseous refrigerant compressed in a refrigeration cycle may flow. The second connection tube 192 may include a liquid tube, through which a liquid refrigerant condensed in the refrigeration cycle may flow.

At least one first tube connector 201 separably coupled to the first and second connection tubes 191 and 192 may be provided in the gas/liquid separation device 200. The gas/liquid separation device 200 may include two first tube connectors 201, for example.

The air conditioning system 10 may include three tubes 193, 194, and 195 that connect the gas/liquid separation device 200 to the distributor 300. The three tubes 193, 194, and 195 may include a third connection tube 193, a fourth connection tube 194, and a fifth connection tube 195, which may be connected to a second side of the gas/liquid separation device 200.

At least one second tube connector 205 separably coupled to the third to fifth connection tubes 193 to 195 may be provided in the gas/liquid separation device 200. The gas/liquid separation device 200 may include three second tube connectors 205, for example.

The air conditioning system 10 may include a plurality of distribution tubes 390 that connect the distributors 300 to the plurality of indoor devices 400. The plurality of distribution tubes that connect the distributors 300 to each indoor device 400 may include an inflow tube that guides introduction of the refrigerant into the respective indoor device 400, and a discharge tube that guides discharge of the refrigerant from the respective indoor device 400.

Detailed components of the air conditioning system 10 will be described hereinbelow.

Figure 3:
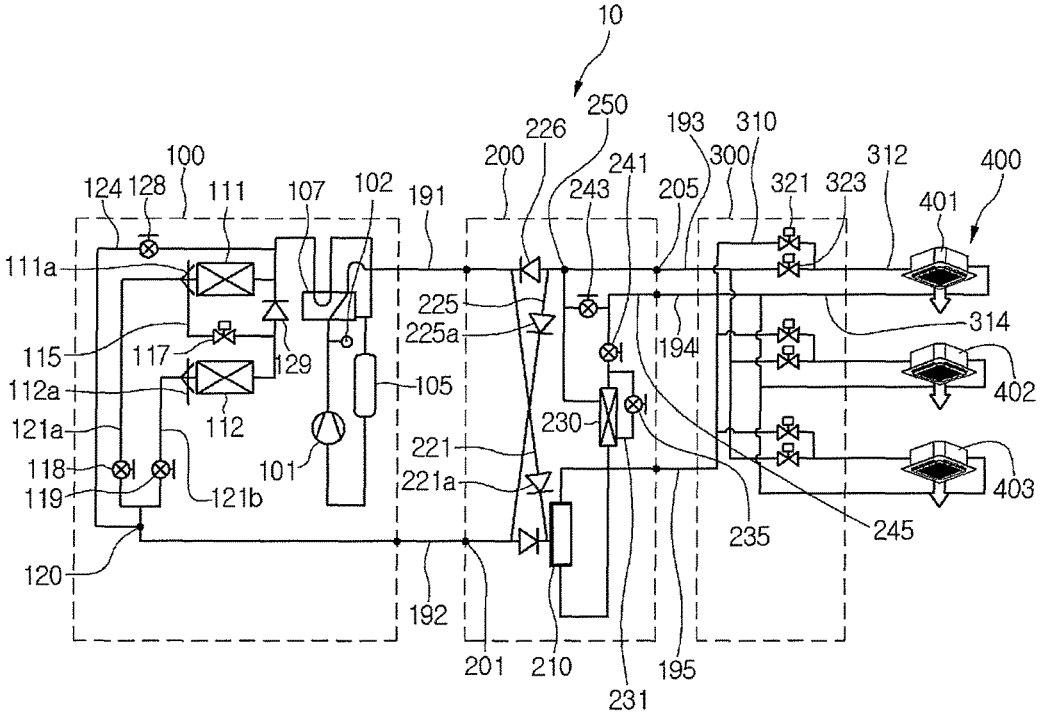
FIG. 3 is a cycle view illustrating components of the air conditioning system of FIG. 2.

FIG. 3 is a cycle view illustrating components of the air conditioning system of FIG. 2. Referring to FIG. 3, the air conditioning system 10 according to an embodiment may include outdoor device 100 disposed in an outdoor space, gas/liquid separation device 200 connected to the outdoor device 100, distributor 300 connected to the gas/liquid separation device 200 to distribute refrigerant, and the plurality of indoor devices 400, in which the refrigerant distributed by the distributor 300 may be introduced and heat-exchanged. The plurality of indoor devices 400 may include a first indoor device 401, a second indoor device 402, and a third indoor device 403.

Although not shown, each of the indoor devices 400 may include an indoor heat exchanger, which may perform heat-exchange with indoor air, and an expansion device (hereinafter, referred to as an "indoor expansion device") to expand the refrigerant introduced into the indoor heat exchanger.

The outdoor device 100 may include a compressor 101, and an outdoor gas/liquid separator 105 disposed on or at an inlet-side of the compressor 101 to separate a liquid refrigerant and a gaseous refrigerant of the refrigerant to be introduced into the compressor 101 from each other. The gaseous refrigerant separated by the outdoor gas/liquid separator 105 may be introduced into the compressor 101.

The outdoor device 100 may include a passage switch 107 that guides the refrigerant compressed in the compressor 101 toward the outdoor heat exchangers 111 and 112 or the gas/liquid separation device 200. The passage switch 107 may include a four-way valve.

When the air conditioning system 10 performs a cooling operation, the refrigerant may be introduced into the outdoor heat exchangers 111 and 112 from the passage switch 107. On the other hand, when the air conditioning system 10 performs a heating operation, the refrigerant may be introduced into the gas/liquid separation device 200 from the passage switch 107.

The outdoor heat exchangers 111 and 112 may include a plurality of heat exchangers. The plurality of heat exchangers may include a first heat exchanger 111 and a second heat exchanger 112, which may be connected substantially in parallel to each other. The first and second heat exchangers 111 and 112 may be connected to tubes that are branched from an outlet-side tube of the passage switch 107.

A check valve 129 may be disposed on or at a side of the first and second heat exchangers 111 and 112. The check valve 129 may be provided in a branch tube that extends from the passage switch 107 to the second heat exchanger 112. The refrigerant passing through the passage switch 107 may not be introduced into the second heat exchanger 112, but rather, may be introduced into the first heat exchanger 111 by the check valve 129.

The first heat exchanger 111 may include a first capillary 111*a* to decompress the refrigerant during the heat operation. The second heat exchanger 112 may include a second capillary 112*a*.

In the cooling operation, the outdoor device 100 may include a variable passage 115 that guides a flow of the refrigerant from an outlet-side of the first heat exchanger 111 to an inlet-side of the second heat exchanger 112, and a variable valve 117 provided in the variable passage 115 to selectively block flow of the refrigerant.

The variable valve 117 may include a solenoid valve that is controllable to turn on/off. The refrigerant passing through the first heat exchanger 111 may be selectively introduced into the second heat exchanger 112 according to the on/off of the variable valve 117.

In detail, when the variable valve 117 is turned on or opened, the refrigerant passing through the first heat exchanger 111 may be introduced into the second heat exchanger 112 via the variable passage 115. Then, the refrigerant may pass through the second heat exchanger 112 to flow into a second outdoor tube 121*b*. On the other hand, when the variable valve 117 is turned off or closed, the refrigerant may pass through the first heat exchanger 111 to flow into a first outdoor tube 121*a*. The first and second outdoor tubes 121*a* and 121*b* may be referred to collectively as "outdoor tube". The outdoor tube may be referred to as an outlet-side tube of the first and second heat exchangers 111 and 112.

The outdoor device 100 may include the first outdoor tube 121*a* that extends from the outlet-side of the first heat exchanger 111, and a first outdoor expansion device 118 provided in the first outdoor tube 121*a* to adjust a flow of the refrigerant. The outdoor device 100 may further include the second outdoor tube 121*b* that extends from the outlet-side of the second heat exchanger 112, and a second outdoor expansion device 119 provided in the second outdoor tube 121*b* to adjust a flow of the refrigerant.

When the first outdoor expansion device 118 is opened or increases in opening degree, an amount of refrigerant flowing into the first heat exchanger 111 and the first outdoor tube 121*a* may increase. Also, when the second outdoor expansion device 119 is opened or increases in opening degree, an amount of refrigerant flowing into the second heat exchanger 112 and the second outdoor tube 121*b* may increase.

The first and second outdoor expansion devices 118 and 119 may be connected in parallel to each other. Also, the first or second outdoor expansion device 118 or 119 may include an electronic expansion valve (EEV). When the heating operation is performed, the first and second outdoor expansion devices 118 and 119 may expand the refrigerant to be introduced into the outdoor heat exchangers 111 and 112.

The outdoor device 100 may include an outdoor combination portion 120, in which the refrigerant passing through the first and second outdoor expansion devices 118 and 119 may be mixed with each other. The refrigerant mixed in the outdoor combination portion 120 may be discharged from the outdoor device 100, and then may be introduced into the gas/liquid separation device 200. The outdoor combination portion 120 may allow the refrigerant to be branched into the first or second outdoor tube 121*a* or 121*b* when the heating operation is performed. Thus, the outdoor combination portion 120 may be referred to as an "outdoor branch".

The outdoor device 100 may further include a bypass tube 124 to bypass at least a portion of the refrigerant flowing to the first or second outdoor tube 121*a* or 121*b*. The bypass tube 124 may extend from the outdoor combination portion 120, and then, may be connected to a tube (hereinafter, referred to as a "passage switching tube") that connects the first outdoor heat exchanger 111 to the passage switch 107. The passage switching tube may be referred to as an outlet-side tube of the compressor 101. That is, the bypass tube 124 may have a first end connected to the outdoor combination portion 120 and a second end connected to the passage switching tube.

A bypass valve 128 to adjust a flow rate of the refrigerant may be disposed in the bypass tube 124. The bypass valve 128 may include an electronic expansion valve (EEV), an opening degree of which is adjustable.

For example, when the heating operation is mainly performed, and the cooling operation is simultaneously performed (a main heating simultaneous cooling operation), at least a portion of the refrigerant flowing into the second connection tube 192 may flow into the bypass tube 124 from the outdoor combination portion 120 to flow into the passage switching tube. The main heating simultaneous cooling operation may represent an operation mode in which the number of indoor devices performing the heating operation among the plurality of indoor devices is greater than the number of indoor devices performing the cooling operation. Also, when the bypass valve 128 increase in opening degree in a state in which the bypass valve 128 is opened, an amount of refrigerant flowing into the bypass tube 124 may increase.

For example, when the main heating simultaneous cooling operation is performed, at least a portion of the refrigerant to be introduced from the passage switch 107 to the first outdoor heat exchanger 111 may bypass the first outdoor heat exchanger 111 to flow into the bypass tube 124. Also, the gaseous refrigerant flowing into the bypass tube 124 may be decompressed in the bypass valve 128 to phase-change into a two-phase refrigerant.

The air conditioning system 10 may include first and second connection tubes 191 and 192 that connect the outdoor device 100 to the gas/liquid separator 200. The first connection tube 191 may extend from the passage switch 107 to the gas/liquid separation device 200, and the second connection tube 192 may extend from the outdoor combination portion 120 to the gas/liquid separation device 200.

The gas/liquid separation device 200 may include a first tube connection portion 201 separably coupled to the first and second connection tubes 191 and 192. Thus, two first tube connection portions 201 may be provided.

The gas/liquid separation device 200 may include bridge circuits 221 and 225 that guide the refrigerant introduced into the gas/liquid separation device 200 through the first or second connection tube 191 or 192. The bridge circuits 221 and 225 may include a first bridge tube 221, and a second bridge tube 225.

The first bridge tube 221 may be coupled to the first connection tube 191 to guide the refrigerant flowing into the first connection tube 191 to the gas/liquid separator 210 when the heating operation is performed. The second bridge tube 225 may be coupled to the second connection tube 192 to guide the refrigerant from the gas/liquid separation device 200 to the second connection tube 192 and the outdoor device 100 when the heating operation is performed.

The bridge circuits 221 and 225 may include a first check valve 221*a* provided in the first bridge tube 221, and a second check valve 225*a* provided in the second bridge tube 225. The first and second check valves 221*a* and 225*a* may guide the refrigerant in one direction in the tubes 221 and 225.

A third check valve 226 may be disposed on or at a side of the bridge circuits 221 and 225. The third check valve 226 may allow the refrigerant introduced into the gas/liquid separation device 200 through the first connection tube 191 to be introduced into the first bridge tube 221, and also prevent the refrigerant from being discharged from the gas/liquid separation device 200 through the third connection tube 193. The third check valve 226 may be disposed in a tube that connects an end of the first bridge tube 221 to an end of the second bridge tube 225.

The gas/liquid separation device 200 may include the gas/liquid separator 210, in which the refrigerant flowing into the first bridge tube 221 or the refrigerant mixed in the outdoor combination portion 120 may be introduced, and then, may be separated into a gaseous refrigerant and a liquid refrigerant. The gaseous refrigerant separated in the gas/liquid separator 210 may be introduced into the distributor 300, and the separated liquid refrigerant may be introduced into a supercooler 230. The supercooler 230 may be disposed on or at an outlet-side of the gas/liquid separator 210.

The supercooler 230 may be referred to as an intermediate heat exchanger, in which a first refrigerant circulating into the system 10 and a portion (a second refrigerant) of the first refrigerant may be branched and then heat-exchanged with each other.

The gas/liquid separation device 200 may include a supercooling passage 231, in which the second refrigerant may be branched. A supercooling expansion device 235 to decompress the second refrigerant may be disposed in the supercooling passage 231. The supercooling expansion device 235 may include an electronic expansion valve (EEV). The supercooling passage 231 may extend to a gas/liquid separation combination portion 250.

A supercooling outlet tube 245 and a first flow rate adjuster 241 provided in the supercooling outlet tube 245 may be disposed on or at an outlet-side of the supercooler 230. The first flow rate adjuster 241 may adjust an amount of first refrigerant passing through the supercooler 230.

For example, when the first flow rate adjuster 241 is opened, the first refrigerant may be heat-exchanged in the supercooler 230. Then, the first refrigerant passing through the supercooler 230 may be introduced into the distributor 300. On the other hand, when the first flow rate adjuster 241 is closed, the first refrigerant may not be heat-exchanged in the supercooler 230.

The gas/liquid separation device 200 may include a second flow rate adjuster 243 disposed in a tube that extends from a point on the supercooling outlet tube 245 to the supercooling passage 231 to adjust an amount of refrigerant that returns to the gas/liquid separation device 200 after passing through the indoor device 400 while the heating operation is performed.

Each of the first and second flow rate adjusters 241 and 243 may include an electronic expansion valve (EEV). Thus, a decompressed degree of the refrigerant passing through the first or second flow rate adjuster 241 or 243 may be adjusted according to an opening degree of the first or second flow rate adjuster 241 or 243.

The second tube connection portion 205 may be provided in the gas/liquid separation device 200. A plurality of connection tubes connected to the distributor 300 may be separably coupled to the second tube connection portion 205. The plurality of connection tubes may include third connection tube 193, fourth connection tube 194, and fifth connection tube 195. Thus, three second tube connection portions 205 may be provided.

The gas/liquid separation device 200 may include the gas/liquid separation combination portion 250, in which the refrigerant may be mixed with each other. For example, when the main heating simultaneous cooling operation is performed, the refrigerant condensed in the first and second indoor devices 401 and 402 and passed through the second flow rate adjuster 243 and the refrigerant evaporated in the third indoor device 403 may be mixed with each other in the gas/liquid separation combination portion 250 (see FIG. 5).

For example, when an exclusive cooling operation is performed, the second refrigerant passing through the supercooler 230 and the refrigerant evaporated in the first to third indoor devices 401, 402, and 403 may be mixed with each other in the gas/liquid separation combination portion 250. The distributor 300 may distribute the refrigerant discharged from the gas/liquid separation device 200 into the plurality of indoor devices 400. In detail, the distributor 300 may include a plurality of distribution tubes 310, 312, and 314 that guide introduction of the refrigerant into one indoor device 400 and discharge the refrigerant from the one indoor device 400. The plurality of distribution tubes 310, 312, and 314 may include a first distribution tube 310, a second distribution tube 312, and a third distribution tube 314.

The first distribution tube 310 may be a tube through which the gaseous refrigerant separated in the gas/liquid separator 210 may flow, the second distribution tube 312 may be a tube connected to the third connection tube 193, and the third distribution tube 314 may be a tube connected to the supercooling outlet tube 245. A first distribution valve 321 may be provided in the first distribution tube 310 to control a flow rate of the refrigerant, and a second distribution valve 323 may be provided in the second distribution tube 312 to control a flow rate of the refrigerant. As illustrated in FIG. 3, the plurality of distribution tubes 310, 312, and 314 and the distribution valves 321 and 323 may be provided to correspond to each of the indoor devices. Also, the plurality of distribution tubes 310, 312, and 314 provided in one indoor device may be branched from the plurality of distribution tubes 310, 312, and 314 provided in another indoor device.

The indoor heat exchanger and the indoor expansion device may be provided in the indoor device 400. When a cooling operation is performed in one indoor device, the refrigerant introduced into the one indoor device may be decompressed in the indoor expansion device, and then, may be evaporated in the indoor heat exchanger.

Hereinafter, an effect and refrigerant flow according to an operation mode of the air conditioning system according to an embodiment will be described.

Figure 4:
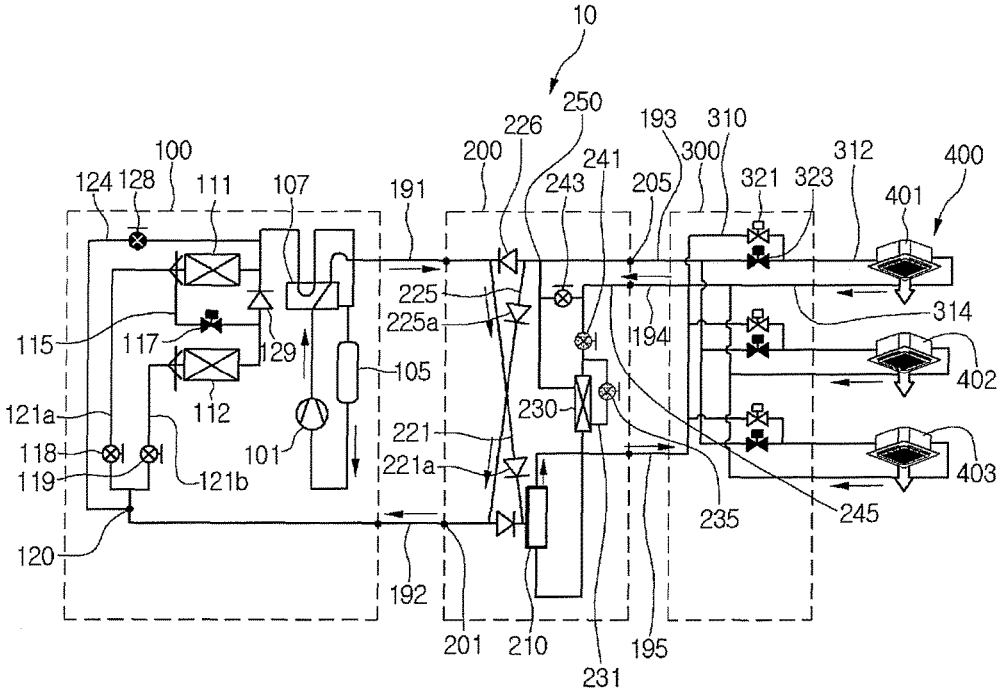
FIG. 4 is a view illustrating a flow of refrigerant during an exclusive heating operation in the air conditioning system of FIG. 2.

FIG. 4 is a view illustrating a flow of refrigerant during an exclusive heating operation in the air conditioning system of FIG. 2. An effect and refrigerant flow when the air conditioning system 10 performs the exclusive heating operation, that is, when all of the indoor devices perform the heating operation, will be described with reference FIG. 4.

The refrigerant compressed in the compressor 101 may flow into the first connection tube 191 through the passage switch 107, and then, may be introduced into the first bridge tube 221. The flow of the refrigerant into the gas/liquid separation combination portion 250 may be restricted by the third check valve 226. Thus, the refrigerant may be guided to the first bridge tube 221, and then, may be introduced into the gas/liquid separator 210.

The refrigerant introduced into the gas/liquid separator 210 may be a high-pressure gaseous refrigerant. The gaseous refrigerant separated in the gas/liquid separator 210 may be introduced into the distributor 300 through the fifth connection tube 195. The supercooling expansion portion 235 and the first flow rate adjuster 241 may be closed, and thus, the refrigerant may not be introduced into the supercooler 230.

The refrigerant introduced into the distributor 300 may be branched to flow into the first distribution tube 310 corresponding to each of the plurality of indoor devices 400, and then, may be introduced into the indoor device 400 and be condensed. The first distribution valve 321 may be opened, and the second distribution valve 323 may be closed. As a result, the heating operation may be performed through the plurality of indoor devices 400.

The refrigerant condensed in each indoor device 400 may be discharged from each indoor device 400 to flow into the third distribution tube 314. The refrigerant flowing into the third distribution tube 314 corresponding to each of the plurality of indoor devices 400 may be mixed with each other to pass through the second flow rate adjuster 243 through the fourth connection tube 194. The second flow rate adjuster 243 may be fully opened, and thus, the refrigerant may not be decompressed.

The refrigerant passing through the second flow rate adjuster 243 may flow into the second bridge tube 225. As the refrigerant flowing into the first bridge tube 221 has a pressure greater than a pressure of the refrigerant passing through the second flow rate adjuster 243, the refrigerant may not pass through the third check valve 226, but rather, may flow into the second bridge tube 225. The refrigerant passing through the second bridge tube 225 may be introduced into the outdoor device 100 through the second connection tube 192.

The refrigerant introduced into the outdoor device 100 may be branched in the outdoor branch 120 to pass through the first outdoor tube 121*a* and the second outdoor tube 121*b*, and then, may be evaporated in the first and second heat exchangers 111 and 112. The refrigerant may be decompressed in the first and second outdoor expansion devices 118 and 119. The bypass valve 128 may be closed to restrict a flow of the refrigerant from the outdoor branch 120 to the bypass tube 124.

Also, the variable valve 117 may be closed. Thus, the refrigerant introduced into the second heat exchanger 112 may not be introduced into the first heat exchanger 111, but rather, may be mixed with the refrigerant discharged from the first heat exchanger 111.

The refrigerant passing through the outdoor heat exchangers 111 and 112 may be introduced into the compressor 101 through the passage switch 107. This refrigerant cycle may be repeatedly performed.

Figure 5:
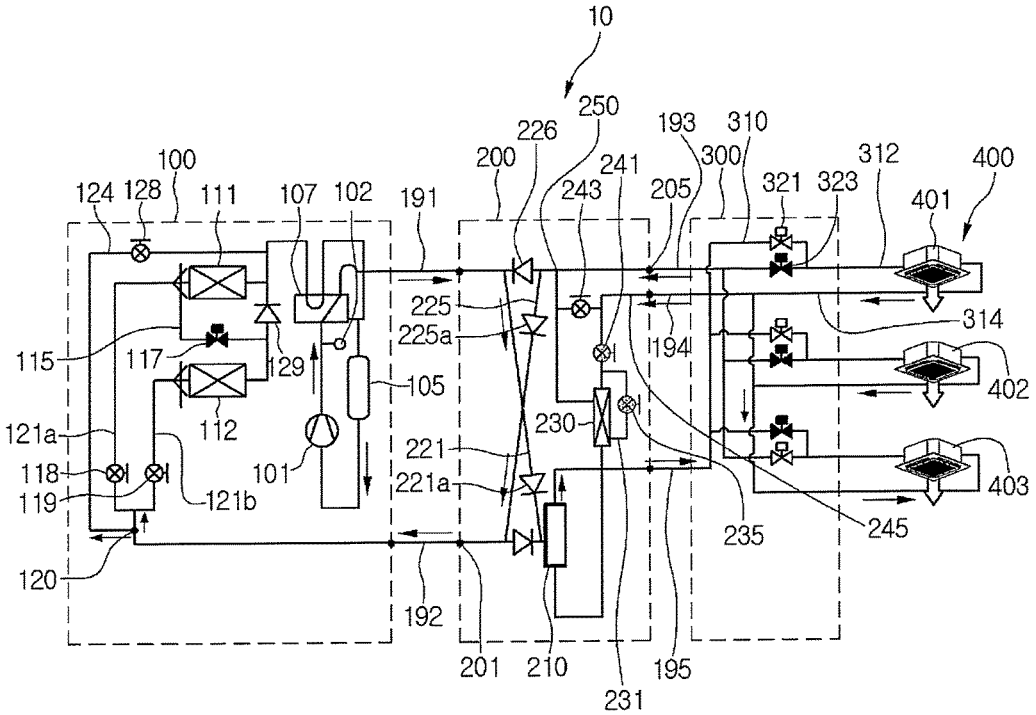
FIG. 5 is a view illustrating a flow of refrigerant when a cooling operation additionally operates during a heating operation in the air conditioning system of FIG. 2.

FIG. 5 is a view illustrating a flow of refrigerant when a cooling operation additionally operates during a heating operation in the air conditioning system of FIG. 2. An effect and refrigerant flow when air conditioning system 10 mainly performs the heating operation, and a portion of the indoor devices perform the simultaneous cooling operation (main heating simultaneous cooling operation) will now be described with reference to FIG. 5.

The term "main heating simultaneous cooling operation" may refer to an operation mode in which a number of indoor devices performing the heating operation are greater than a number of indoor devices performing the cooling operation.

The refrigerant compressed in the compressor 101 may flow into the first connection tube 191 through the passage switch 107, and then, may be introduced into the first bridge tube 221. The refrigerant may not flow into the gas/liquid separation combination portion 250 by the third check valve 226, but rather, may be guided to the first bridge tube 221, and then, may be introduced into the gas/liquid separator 210.

The refrigerant introduced into the gas/liquid separator 210 may be a high-pressure gaseous refrigerant. The gaseous refrigerant separated in the gas/liquid separator 210 may be introduced into the distributor 300 through the fifth connection tube 195. The supercooling expansion portion 235 and the first flow rate adjuster 241 may be closed, and thus, the refrigerant may not be introduced into the supercooler 230.

The refrigerant introduced into the distributor 300 may flow into the first distribution tube 310 corresponding to the first and second indoor devices 401 and 402 and then, may be condensed in the first and second indoor devices 401 and 402. Thus, the heating operation may be performed in or by the first and second indoor devices 401 and 402.

Also, at least a portion of the refrigerant condensed in the first and second indoor devices 401 and 402 may be mixed with each other to flow into the third indoor device 403. The refrigerant introduced into the third indoor device 403 may be decompressed while passing through the indoor expansion device, and then, may be evaporated in the indoor heat exchanger. Thus, the cooling operation may be performed through the third indoor device 403.

Also, the refrigerant evaporated in the third indoor device 403 may be discharged from the third indoor device 403 to flow into the second distribution tube 312. Then, the refrigerant may be introduced into the gas/liquid separation device 200 via the third connection tube 193.

The refrigerant condensed in the first and second indoor devices 410 and 402 may pass through the second flow rate adjuster 243 via the fourth connection tube 194. The second flow rate adjuster 243 may be disposed on or at an outlet-side of the first and second indoor devices 401 and 402.

The refrigerant may be decompressed according to the opening degree of the second flow rate adjuster 243 while passing through the second flow rate adjuster 243. For example, the more the opening degree of the second flow rate adjuster 243 decreases, the more the decompression effect may increase.

Also, the opening degree of the second flow rate adjuster 243 may be adjusted according to an amount of refrigerant to be introduced into the third indoor device 403. For example, if the opening degree of the second flow rate adjuster 243 decreases, an amount of refrigerant introduced into the third indoor device 403 may increase when compared to an amount of refrigerant introduced into the second flow rate adjuster 243. Also, an aspect of reliability in the refrigeration cycle, a low pressure (an evaporation pressure) may decrease.

On the other hand, if the opening degree of the second flow rate adjuster 243 increases, an amount of refrigerant introduced into the third indoor device 403 may decrease when compared to an amount of refrigerant introduced into the second flow rate adjuster 243. Also, an aspect of reliability in the refrigeration cycle, the low pressure (the evaporation pressure) may increase. Thus, the opening degree of the second flow rate adjuster 243 may be controlled to a proper level in consideration of cooling performance of the third indoor device 403 and reliability of the refrigeration cycle.

The refrigerant decompressed in the second flow rate adjuster 243 may be evaporated in the third indoor device 403, and then, may be mixed with the refrigerant introduced into the gas/liquid separation device 200 via the third connection tube 193 in the gas/liquid separation combination portion 250.

Also, the mixed refrigerant may be introduced into the outdoor device 100 through the second bridge tube 225. The mixed refrigerant may be a two-phase refrigerant in which gaseous refrigerant and liquid refrigerant are mixed with each other.

The refrigerant introduced into the outdoor device 100 may be branched in the outdoor branch 120 to pass through the first outdoor tube 121*a* and the second outdoor tube 121*b*, and then, may be evaporated in the first and second heat exchangers 111 and 112.

The variable valve 117 may be closed. Thus, the refrigerant introduced into the second heat exchanger 112 may not be introduced into the first heat exchanger 111, but rather, may be mixed with the refrigerant discharged from the first heat exchanger 111. Also, the evaporated refrigerant may be introduced into the compressor 101 via the passage switch 107.

The bypass valve 128 may be opened. The two-phase refrigerant may pass through the first outdoor expansion device 118 and the first capillary 111*a* while flowing into the first outdoor tube 121*a*. A pressure loss may occur. More particularly, a pressure loss due to the gaseous refrigerant of the two-phase refrigerant may be relatively high.

If the pressure loss is too high, the low pressure may be reduced, deteriorating operation performance. Thus, in this embodiment, at least a portion of the refrigerant to be introduced into the first or second outdoor tube 121*a* or 121*b* may be bypassed into the bypass tube 124.

The bypass valve 128 may be opened to a predetermined opening degree. Thus, at least a portion of the refrigerant flowing into the second connection tube 192 may flow into the bypass tube 124 from the outdoor branch 120.

As described above, as the bypass tube 124 as well as the first and second outdoor tubes 121*a* and 121*b* is opened, a flow space of the refrigerant may be secured to reduce pressure loss. The refrigerant flowing into the bypass tube 124 may be introduced into the passage switch 107 via the passage switching tube, and then, may be introduced into the compressor 101 via the outdoor gas/liquid separator 105.

Hereinafter, a flow of the refrigerant when the cooling operation is performed will be described with reference to FIG. 3. An effect and refrigerant flow when the air conditioning system 10 performs the exclusive cooling operation, that is, all of the indoor devices perform the cooling operation will now be described.

The refrigerant compressed in the compressor 101 may be introduced into the first outdoor heat exchanger 111 through the passage switch 107, and then, may be condensed. Also, the variable valve 117 may be opened. Thus, a first portion of the refrigerant passing through the first outdoor heat exchanger 111 may flow into the first outdoor tube 121*a*, and a second portion may be introduced into the second outdoor heat exchanger 112 via the variable valve 117, and then, may be condensed.

The refrigerant flowing into the first outdoor tube 121*a* may pass through the first outdoor expansion device 118, and the refrigerant discharged from the second outdoor heat exchanger 112 may flow into the second outdoor tube 121*b* to pass through the second outdoor expansion device 119. The bypass valve 128 may be closed to restrict a flow of the refrigerant.

As described above, in the case of the exclusive cooling operation, the variable valve 117 may be opened to allow the refrigerant to successively pass through the plurality of heat exchangers 111 and 112, thereby being condensed. However, if the desired cooling performance is low, the variable valve 117 may be closed to allow the refrigerant to pass through only the first heat exchanger 111.

The refrigerant discharged from the outdoor device 100 may flow into the second connection tube 192, and then, may be introduced into the gas/liquid separator 210. The refrigerant introduced into the gas/liquid separator 210 may be condensed refrigerant, and all or most of the refrigerant may be in liquid refrigerant form. The liquid refrigerant separated in the gas/liquid separator 210 may pass through the supercooler 230 and the first flow rate adjuster 241, and then, may be introduced into the distributor 300 through the fourth connection tube 194.

The supercooling expansion portion 235 and the first flow rate adjuster 241 may be opened to allow the first and second refrigerant to heat-exchanged with each other in the supercooler 230. A cooling degree of the first refrigerant and a heating degree of the second refrigerant in the supercooler 230 may be controlled according to an opening degree of the supercooling expansion portion 235.

The refrigerant passing through the supercooler 230, that is, the first refrigerant may be introduced into the third distribution tube 314 through the fourth connection tube 194, and then, may be evaporated in the indoor device 400. In this embodiment, when the plurality of indoor devices 400 is provided, the refrigerant may be branched into the third distribution tube 314 corresponding to each of the plurality of indoor devices 400, and then, may be introduced into the plurality of indoor devices 400.

The refrigerant evaporated in the plurality of indoor devices 400 may flow into the second distribution tube 312, and then, may be mixed with each other. Then, the refrigerant may be introduced into the gas/liquid separation device 200 through the third connection tube 193.

The refrigerant evaporated in the indoor device 400 may be mixed with the second refrigerant passing through the supercooler 230 in the gas/liquid separation combination portion 250. Then, the mixed refrigerant may be introduced into the outdoor device 100 through the first connection tube 191 and be compressed in the compressor 101. This refrigerant cycle may be repeatedly performed. The first distribution valve 321 may be closed to restrict a flow of the refrigerant from the gas/liquid separator 210 to the first distribution tube 310.

Next, an effect and refrigerant flow when the heating operation is additionally performed during the cooling operation, that is, when the cooling operation is mainly performed, and a portion of the indoor devices performs the heating operation (the main cooling simultaneous heating operation) will be described hereinbelow. The term "main cooling simultaneous heating operation" may refer to an operation mode in which a number of indoor devices performing the cooling operation are greater than a number of indoor devices performing the heating operation.

The refrigerant compressed in the compressor 101 may be branched into the first outdoor heat exchanger 111 and the bypass tube 124 through the passage switch 107. The bypass valve 128 and the variable valve 117 may be opened.

Thus, a first portion of the refrigerant passing through the first outdoor heat exchanger 111 may be introduced into the first outdoor expansion device 118 through the first outdoor tube 121*a*. A second remaining portion of the refrigerant may be introduced into the second outdoor heat exchanger 112 via the variable valve 117 and be condensed. Then, the refrigerant may be introduced into the second outdoor expansion device 119.

As described above, the first portion of the refrigerant compressed in the compressor 101 may flow through the bypass valve 128, and the second remaining portion of the refrigerant may pass through the outdoor heat exchangers 111 and 112. Thus, the refrigerant discharged from the outdoor device 110 may have a two-phase state having a pressure greater than a predetermined high pressure.

An opening degree of the bypass valve 128 may be adjusted according to an amount of refrigerant introduced into the first indoor device 401 that performs the heating operation. Whether an amount of refrigerant introduced into the first indoor device 401 is lacking may be determined on the basis of a high pressure (a condensation pressure) of the refrigeration cycle. If an amount of refrigerant in the first indoor device 401 is lacking, the high pressure may decrease.

For example, if the refrigerant introduced into the first indoor device 401 is sufficient, an opening degree of the bypass valve 128 may decrease. On the other hand, if the refrigerant introduced into the first indoor device 401 is insufficient, an opening degree of the bypass valve 128 may increase to control an amount of refrigerant so that a larger amount of high-pressure gaseous refrigerant may be introduced into the first indoor device 401.

The refrigerant discharged from the outdoor device 100 may be the two-phase refrigerant. The two-phase refrigerant may be introduced into the gas/liquid separator 210 through the second connection tube 192.

The gaseous refrigerant separated in the gas/liquid separator 210 may flow into the first distribution tube 310 corresponding to the first indoor device 410 through the fifth connection tube 195. Then, the refrigerant may be introduced into the first indoor device and be condensed. Thus, the first indoor device 401 may perform the heating operation.

The refrigerant condensed in the first indoor device 401 may be branched into the second and third indoor devices 402 and 403 through the third distribution tube 314. The refrigerant introduced into the second and third indoor devices 402 and 403 may be expanded in the indoor expansion device and evaporated in the indoor heat exchanger to perform the cooling operation.

The refrigerant evaporated in the second and third indoor devices 402 and 403 may be mixed with each other, and then, may be introduced into the gas/liquid separation device 200 through the third connection tube 193. The liquid refrigerant separated in the gas/liquid separator 210 may selectively pass through the supercooler 230. In detail, the first flow rate adjuster 241 may be adjusted in opening degree according to whether an amount of refrigerant to be introduced into the second and third indoor devices 402 and 403 is lacking. For example, if an amount of refrigerant to be introduced into the second and third indoor devices 402 and 403 is lacking, the low pressure may increase.

If an amount of refrigerant to be introduced into the second and third indoor devices 402 and 403 is lacking, an opening degree of the first flow rate adjuster 24 may be increased. Thus, an amount of refrigerant introduced into the second and third indoor devices 402 and 403 from or through the first flow rate adjuster 241 may increase.

Here, the refrigerant passing through the first flow rate adjuster 241 may be mixed with the refrigerant passing through the first indoor device 401, and then, may be introduced into the second and third indoor devices 402 and 403. On the other hand, if an amount of refrigerant to be introduced into the second and third indoor devices 402 and 403 is sufficient, an opening degree of the first flow rate adjuster 241 may decrease or be closed. Thus, an amount of refrigerant introduced into the second and third indoor devices 402 and 403 from or through the first flow rate adjuster 241 may decrease.

When the first flow rate adjuster 241 is opened, a supercooling degree of the first refrigerant or an overheating degree of the second refrigerant may be controlled according to an opening degree of the supercooling expansion portion 235. The refrigerant evaporated in the second and third indoor devices 402 and 403, and the second refrigerant passing through the supercooler 230 may be mixed with each other in the gas/liquid combination portion 250. The mixed refrigerant may be introduced into the outdoor device 100 through the first connection tube 191. As the refrigerant flowing into the second connection tube 192 has a pressure greater than a pressure of the refrigerant mixed in the gas/liquid separation combination 250, a flow of the mixed refrigerant into the first or second bridge tube 221 or 225 may be restricted to flow into the first connection tube 191.

The refrigerant introduced into the outdoor device 100 may be compressed in the compressor 101 via the passage switch 107. This refrigeration cycle may be repeatedly performed.

Figure 6:
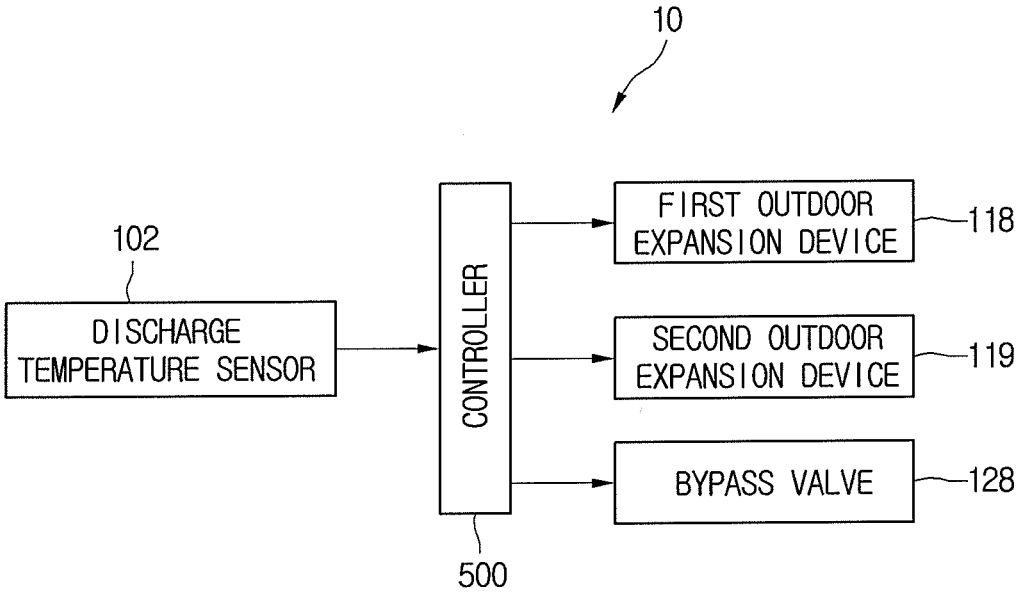
FIG. 6 is a block diagram of the air conditioning system of FIG. 2.

FIG. 6 is a block diagram of the air conditioning system of FIG. 2. Referring to FIG. 6, the air conditioning system 10 according to an embodiment may include a discharge temperature sensor 102 that detects a discharge temperature of the refrigerant in the compressor 101, and a controller 500 that controls an operation of the bypass valve 128 on the basis of information with respect to the discharge temperature or a discharge overheating degree of the refrigerant in the compressor 101, which may be detected by the discharge temperature sensor 101.

The discharge overheating degree may be calculated through a difference between the discharge temperature detected by the discharge temperature sensor 101 and an ideal discharge temperature. The ideal discharge temperature may be previously set or predetermined.

The discharge temperature or the discharge overheating degree may be reference factors for determining whether the refrigerant in the system is lacking, that is, the gaseous refrigerant suctioned into the compressor 101 is sufficient or insufficient. For example, if the discharge temperature or the discharge overheating degree is low, it may be determined that the gaseous refrigerant suctioned into the compressor 101 is lacking. That is, it may be understood that a large amount of liquid refrigerant is introduced into the outdoor gas/liquid separator 105, and a relatively small amount of gaseous refrigerant separated from the liquid refrigerant in the compressor 101 is suctioned.

On the other hand, if the discharge temperature or the discharge overheating degree is high, it may be determined that an amount of the gaseous refrigerant suctioned into the compressor 101 is excessive. That is, it may be understood that a small amount of liquid refrigerant is introduced into the outdoor gas/liquid separator 105, and a relatively large amount of gaseous refrigerant separated from the liquid refrigerant in the compressor 101 is suctioned.

Thus, if the discharge temperature or the discharge overheating degree is low, an opening degree of the bypass valve 128 may decrease to reduce an amount of two-phase refrigerant flowing into the bypass tube 124. In this case, as a relatively large amount of refrigerant is evaporated through the first and second heat exchangers 111 and 112, an amount of two-phase refrigerant introduced into the outdoor gas/liquid separator 105, that is, an amount of liquid refrigerant may be reduced to suction a relatively large amount of gaseous refrigerant into the compressor 101.

On the other hand, if the discharge temperature or the discharge overheating degree is high, an opening degree of the bypass valve 128 may increase to increase an amount of two-phase refrigerant flowing into the bypass tube 124. In this case, as a relatively small amount of refrigerant is evaporated through the first and second heat exchangers 111 and 112, an amount of two-phase refrigerant introduced into the outdoor gas/liquid separator 105, that is, an amount of liquid refrigerant may increase to suction a relatively small amount of gaseous refrigerant into the compressor 101.

Figure 7:
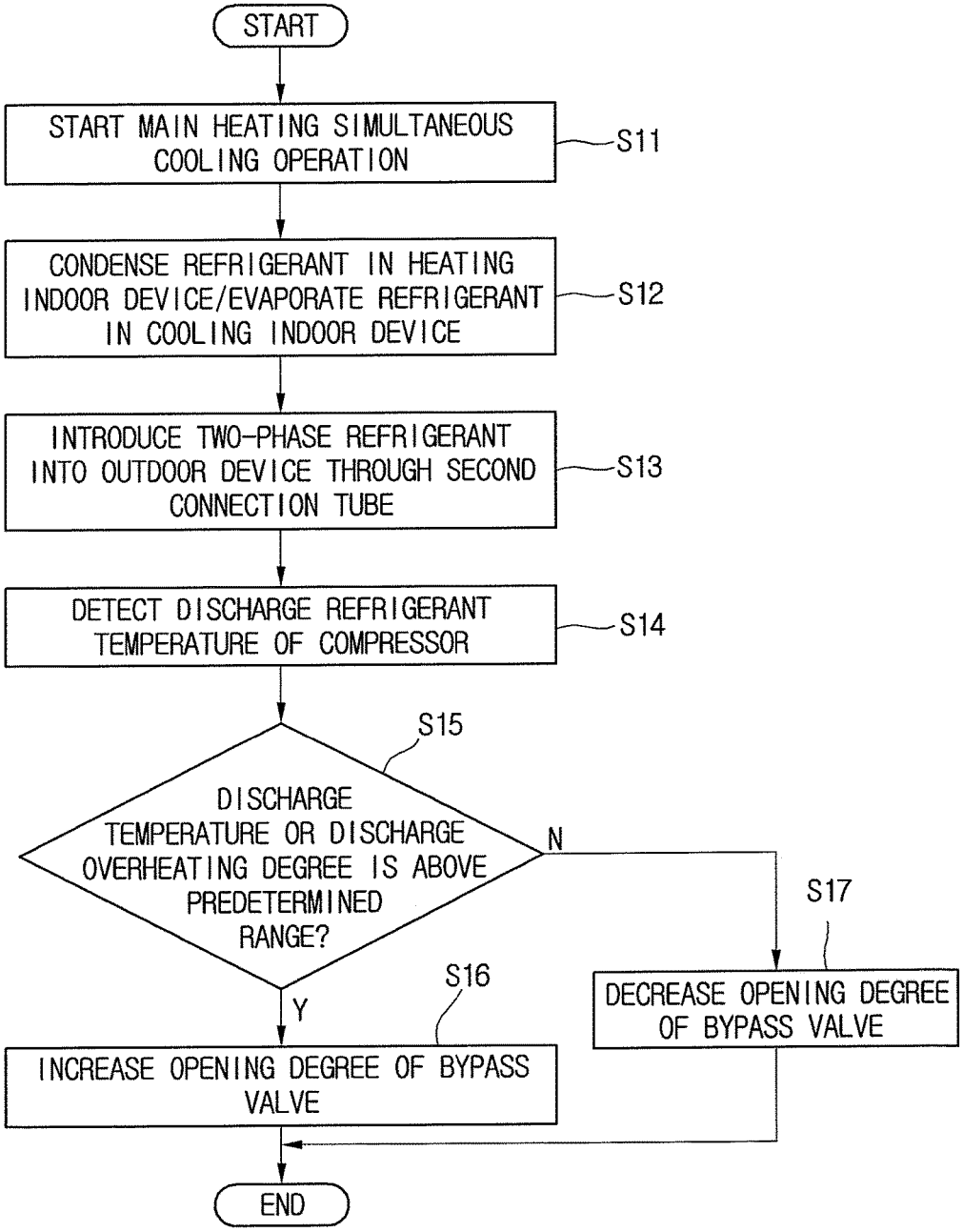
FIG. 7 is a flowchart of a method of controlling an air conditioning system according to an embodiment.
Figure 8:
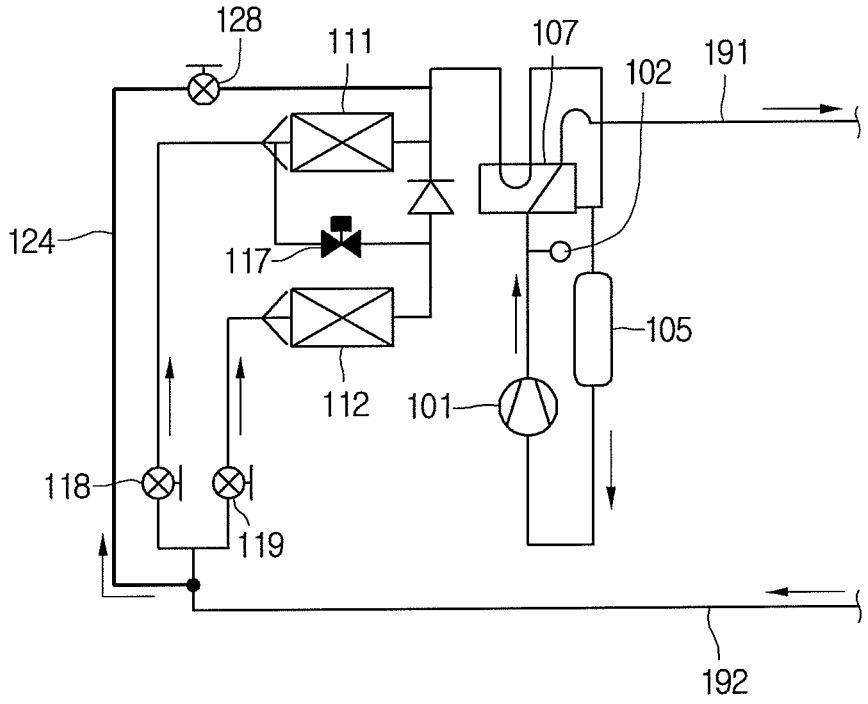
FIGS. 8 and 9 are views illustrating a process of controlling a bypass valve when the cooling operation additionally operates during the heating operation in the air conditioning system according to embodiments.
Figure 9:
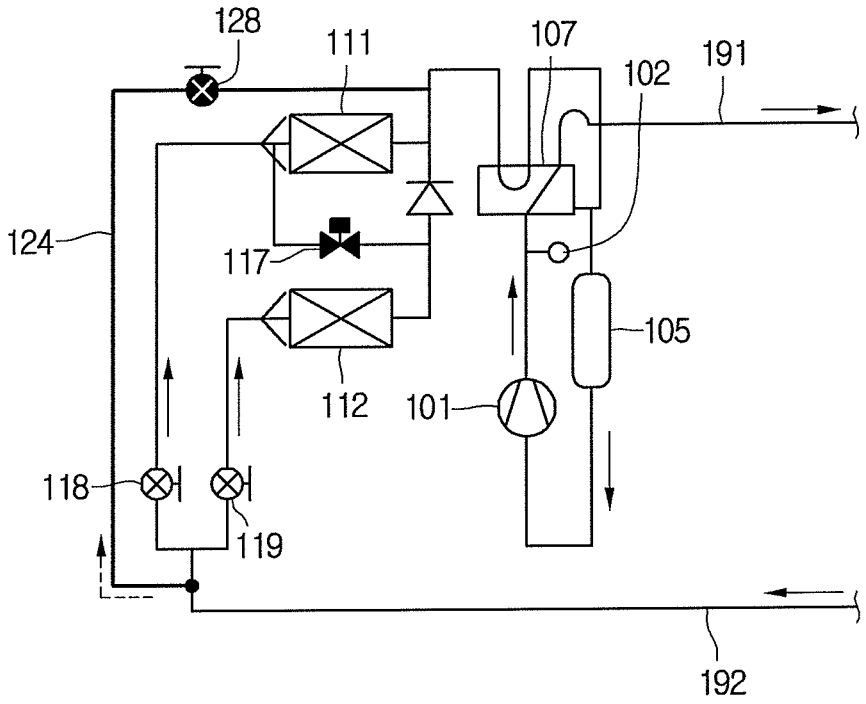

FIG. 7 is a flowchart of a method of controlling an air conditioning system according to an embodiment. FIGS. 8 and 9 are views illustrating a process of controlling a bypass valve when the cooling operation additionally operates during the heating operation in the air conditioning system according to embodiments.

When the air conditioning system 10 performs the main heating simultaneous cooling operation, the compressor 101 may operate to form the refrigerant cycle. Also, the refrigerant may be condensed in the heating indoor device of the plurality of indoor devices and be evaporated in the cooling indoor device.

The refrigerant condensed while passing through the heating indoor device may be decompressed in the second flow rate adjuster 243, and then, may be mixed with the refrigerant evaporated in the cooling indoor device to flow into the second connection tube 192. That is, the two-phase refrigerant may be introduced into the outdoor device 100 through the second connection tube 192. At least a first portion of the refrigerant introduced into the outdoor device 100 may flow into the bypass tube 124, and then, be introduced into the outdoor gas/liquid separator 105 via the passage switch 107. A second remaining portion of the refrigerant introduced into the outdoor 100 may be introduced into the first and second heat exchangers 111 and 112 through the first and second outdoor tubes 121*a* and 121*b*, and then, may be evaporated while passing through the first and second heat exchangers 111 and 112. Also, the evaporated refrigerant may be mixed with the refrigerant flowing into the bypass tube 124, and then, may be introduced into the outdoor gas/liquid separator 105 via the passage switch 107, in steps S11, S12, and S13.

As described above, while the refrigerant cycle operates, a discharge temperature of the refrigerant in the compressor 101 may be detected, in step S14. The discharge temperature or the discharge overheating degree of the refrigerant may be determined through the detected information. It is determined whether the discharge temperature or the discharge overheating degree of the refrigerant is above a preset or predetermined range, in step S15.

If the discharge temperature or the discharge overheating degree of the refrigerant is above the predetermined range, it may be determined that an amount of refrigerant circulating the system, that is, an amount of refrigerant suctioned into the compressor 101 is excessive. Thus, an opening degree of the bypass valve 128 may be increased, in step S16, as illustrated in FIG. 8. Thus, an amount of refrigerant flowing into the bypass tube 124 may increase (a solid arrow).

In this case, as a relatively large amount of two-phase refrigerant is introduced into the outdoor gas/liquid separator 105, a relatively small amount of gaseous refrigerant may be suctioned into the compressor 101. Thus, the discharge temperature or the discharge overheating degree of the refrigerant may be controlled to decrease.

On the other hand, if the discharge temperature or the discharge overheating degree of the refrigerant is below the predetermined range, it may be determined that an amount of refrigerant circulating in the system, that is, an amount of refrigerant suctioned into the compressor 101 is lacking. Thus, an opening degree of the bypass valve 128 may be decreased, in step S17, as illustrated in FIG. 9. Thus, an amount of refrigerant flowing into the bypass tube 124 may decrease (a dotted line arrow).

In this case, as a relatively small amount of two-phase refrigerant is introduced into the outdoor gas/liquid separator 105, a relatively large amount of gaseous refrigerant may be suctioned into the compressor 101. Thus, the discharge temperature or the discharge overheating degree of the refrigerant may be controlled to increase, in step S17.

In the case of the main heating simultaneous cooling operation, the pressure loss in the outdoor device may be reduced through the above-described processes. Also, as the opening degree of the bypass valve may be adjusted on the basis of the discharge temperature or the discharge overheating degree, an amount of refrigerant circulating in the system may be adequately adjusted.

According to embodiments, refrigerant condensed in the refrigeration cycle may be provided into the bypass structure, so that the refrigerant does not pass through the expansion device of the outdoor heat exchanger, but rather, is bypassed into the inlet-side of the compressor, to reduce pressure loss during the main heating simultaneous cooling operation. Also, the amount of bypassed refrigerant may be adjusted on the basis of the discharge temperature or the discharge overheating degree of the refrigerant in the compressor to prevent a lack of refrigerant in the system from occurring, thereby improving operation performance.

Further, the gas/liquid separator may be provided between the outdoor device and the distributor, and the outdoor device and the gas/liquid separator may be connected by two tubes to reduce material cost and a number of welded portions, thereby improving installation reliability.

Furthermore, the gas/liquid separator may be provided to perform the simultaneous operation, in which cooling and heating operations may be simultaneously performed in the air conditioning system, and a switchable operation, in which the cooling and heating operations are switched, in the same outdoor device.

Also, as the gas/liquid separator is separably coupled to the outdoor device and the distributor through the tube connection portion, the gas/liquid separator may be easily installed and replaced. Additionally, if the gas/liquid separator and the distributor are removed, the switchable operation through the outdoor device and the indoor device may be enabled.

Embodiments disclosed herein provide an air conditioning system in which a pressure loss is capable of being reduced.

Embodiments disclosed herein provide an air conditioning system that may include an outdoor unit or device disposed in an outdoor space, the outdoor unit including a compressor and an outdoor heat exchanger; a plurality of indoor units or devices disposed in an indoor space, the plurality of indoor units including an indoor heat exchanger; and a distribution unit or distributor that distributes and introduces a refrigerant into the plurality of indoor units. The outdoor unit may include an outdoor branch part or branch branched into a plurality of refrigerant paths; a first outdoor tube that extends from the outdoor branch part to guide the refrigerant to a first heat exchange part or heat exchanger of the outdoor heat exchanger; a second outdoor tube that extends from the outdoor branch part to guide the refrigerant to a second heat exchange part or heat exchanger of the outdoor heat exchanger; and a bypass tube that extends from the outdoor branch part to allow the refrigerant to bypass the outdoor heat exchanger, thereby guiding the refrigerant to the compressor.

The air conditioning system may further include an outdoor gas/liquid separator provided in an inlet-side of the compressor to separate a gaseous refrigerant from the refrigerant. The refrigerants flowing into the first outdoor tube, the second outdoor tube, and the bypass tube may be mixed with each other and be introduced into the outdoor gas/liquid separator.

An opening degree-adjustable bypass valve device or bypass valve may be disposed in the bypass tube. The bypass valve device may include an electronic expansion valve (EEV).

The air conditioning system may further include a discharge temperature sensor that detects a discharge temperature of the refrigerant in the compressor. An opening degree of the bypass valve device may be adjusted on the basis of information detected by the discharge temperature sensor.

The air conditioning system may further include a controller that controls the bypass valve device to increase an opening degree of the bypass valve device when a discharge temperature or a discharge overheating degree of the refrigerant, which may be detected by the discharge temperature sensor, is above a preset or predetermined range. The controller may control the bypass valve device to decrease an opening degree of the bypass valve device when the discharge temperature or the discharge overheating degree of the refrigerant, which may be detected by the discharge temperature sensor, is below the preset range.

The air conditioning system may further include a first outdoor expansion device provided in the first outdoor tube, and a second outdoor expansion device provided in the second outdoor tube. At least one of the first outdoor expansion device or the second outdoor expansion devices may include an electronic expansion valve (EEV).

The air conditioning system may further include a variable passage that extends from the first heat exchange part to the second heat exchange part of the outdoor heat exchanger; and a variable valve disposed on the variable passage to selectively block a flow of the refrigerant flowing into the variable passage.

The air conditioning system may further include a gas/liquid separation unit or device separably coupled to the outdoor unit and the distribution unit to separate the refrigerant discharged from the outdoor unit into a gaseous refrigerant and a liquid refrigerant. The gas/liquid separation unit may further include a supercooler disposed at an outlet-side of the gas/liquid separator and in which the liquid refrigerant separated in the gas/liquid separator, and a branched refrigerant, in which at least a portion of the liquid refrigerant may be branched, may be heat-exchanged with each other. The gas/liquid separation unit may include a first bridge tube, in which a first check valve may be disposed, the first bridge tube guiding the refrigerant introduced into the gas/liquid separation unit to the gas/liquid separator; and a second bridge tube, in which a second check valve may be disposed, the second bridge tube guiding the refrigerant of the gas/liquid separation unit to the outdoor unit.

The outdoor unit and the gas/liquid separation unit may be separably connected to each other through two tubes, and the gas/liquid separation unit and the distribution unit may be separably connected to each other through three tubes.

Embodiments disclosed herein further provide a method of controlling an air conditioning system that may include driving a compressor disposed in an outdoor unit or device to perform a main heating simultaneous cooling operation, in which a portion of a plurality of indoor units or devices performs a heating operation, and a remaining portion of the plurality of indoor units performs a cooling operation; opening an outdoor expansion device disposed in an outdoor tube to introduce a two-phase refrigerant, which may be introduced into the outdoor unit, into an outdoor heat exchanger; and opening a bypass valve device or bypass valve disposed in a bypass tube to bypass at least a portion of the two-phase refrigerant to be introduced into the outdoor heat exchanger. The outdoor tube and the bypass tube may be branched to extend from the outdoor branch part or branch.

The air conditioning system may further include a discharge temperature sensor that detects a refrigerant discharge temperature of the compressor. The method of controlling the air conditioning system may further include determining whether a refrigerant discharge temperature or a discharge overheating degree is above a preset or predetermined range on the basis of information detected by the discharge temperature sensor.

When the refrigerant discharge temperature or the discharge overheating degree is above the preset range, the bypass valve device may increase in opening degree, and when the refrigerant discharge temperature or the discharge overheating degree is below the preset range, the bypass valve device may decrease in opening degree.

The outdoor tube may include a first outdoor tube connected to a first heat exchange part or heat exchanger of the outdoor heat exchanger, and a second outdoor tube connected to a second heat exchange part or heat exchanger of the outdoor heat exchanger. The air conditioning system may further include a variable passage that connects the first heat exchange part to the second heat exchange part.

The air conditioning system may further include a flow rate adjustment part or flow rate adjuster through which at least a portion of the refrigerant passing through the indoor unit that performs the heating operation may pass. A remaining portion of the refrigerant passing through the indoor unit may be introduced into the indoor unit that performs the cooling operation, and the method of controlling the air conditioning system may further include adjusting an amount of refrigerant to be introduced into the indoor unit that performs the cooling operation.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning system, comprising:

an outdoor device disposed in an outdoor space, the outdoor device comprising a compressor and an outdoor heat exchanger;

a plurality of indoor devices disposed in an indoor space, the plurality of indoor devices each comprising an indoor heat exchanger; and a distributor that distributes and introduces a refrigerant into the plurality of indoor devices, wherein the outdoor device comprises:

an outdoor branch branched into a plurality of refrigerant paths;

a first outdoor tube that extends from the outdoor branch to guide the refrigerant to a first heat exchanger of the outdoor heat exchanger;

a second outdoor tube that extends from the outdoor branch to guide the refrigerant to a first side of a second heat exchanger of the outdoor heat exchanger;

a bypass tube that extends from the outdoor branch to allow the refrigerant to bypass the outdoor heat exchanger, thereby guiding the refrigerant to the compressor;

a variable passage that extends from a second side of the second heat exchanger to the first outdoor tube; and a variable valve disposed in the variable passage to selectively block a flow of the refrigerant flowing into the variable passage.

2. The air conditioning system according to claim 1, further comprising an outdoor gas/liquid separator provided at an inlet-side of the compressor to separate a gaseous refrigerant from the refrigerant, wherein the refrigerants flowing into the first outdoor tube, the second outdoor tube, and the bypass tube are mixed with each other and introduced into the outdoor gas/liquid separator.

3. The air conditioning system according to claim 1, further comprising a bypass valve disposed in the bypass tube, wherein an opening degree of the bypass valve is adjustable.

4. The air conditioning system according to claim 3, wherein the bypass valve comprises an electronic expansion valve (EEV).

5. The air conditioning system according to claim 3, further comprising a discharge temperature sensor that detects a discharge temperature of the refrigerant in the compressor, wherein an opening degree of the bypass valve is adjusted on the basis of information detected by the discharge temperature sensor.

6. The air conditioning system according to claim 5, further comprising a controller that controls the bypass valve to increase the opening degree of the bypass valve when the discharge temperature or the discharge overheating degree of the refrigerant, which is detected by the discharge temperature sensor, is above a predetermined range.

7. The air conditioning system according to claim 6, wherein the controller controls the bypass valve to decrease the opening degree of the bypass valve when the discharge temperature or the discharge overheating degree of the refrigerant is below the predetermined range.

8. The air conditioning system according to claim 1, further comprising:

a first outdoor expansion device provided in the first outdoor tube; and a second outdoor expansion device provided in the second outdoor tube.

9. The air conditioning system according to claim 8, wherein at least one of the first outdoor expansion device or the second outdoor expansion device comprises an electronic expansion valve (EEV).

10. The air conditioning system according to claim 1, further comprising a gas/liquid separation device separably coupled to the outdoor device and the distributor, wherein the gas/liquid separation device comprises a gas/liquid separator that separates the refrigerant discharged from the outdoor device into gaseous refrigerant and liquid refrigerant.

11. The air conditioning system according to claim 10, wherein the gas/liquid separation device further comprises a supercooler disposed at an outlet-side of the gas/liquid separator, and in which the liquid refrigerant separated in the gas/liquid separator and a branched refrigerant in which at least a portion of the liquid refrigerant is branched are heat-exchanged with each other.

12. The air conditioning system according to claim 10, wherein the gas/liquid separation device comprises:

a first bridge tube, in which a first check valve is disposed, wherein the first bridge tube guides the refrigerant to the gas/liquid separator; and a second bridge tube, in which a second check valve is disposed, wherein the second bridge tube guides the refrigerant from the gas/liquid separator to the outdoor device.

13. The air conditioning system according to claim 10, wherein the outdoor device and the gas/liquid separation device are separably connected to each other through two tubes, and wherein the gas/liquid separation device and the distributor are separably connected to each other through three tubes.

14. The air conditioning system according to claim 10, further comprising:

a passage switch that guides refrigerant from the compressor to the outdoor heat exchanger or to the gas/liquid separation device;

a branch tube extending from the passage switch to the second heat exchanger of the outdoor heat exchanger; and a check valve disposed on the branch tube that blocks refrigerant from flowing from the passage switch to the second heat exchanger of the outdoor heat exchanger, and allows refrigerant to flow from the second heat exchanger to the passage switch.

* * * * *